US009721454B2

(12) United States Patent
Hou et al.

(10) Patent No.: US 9,721,454 B2
(45) Date of Patent: Aug. 1, 2017

(54) METHOD FOR PROTECTING TERMINAL DEVICES AND THE TERMINAL DEVICE THEREOF

(71) Applicant: Xiaomi Inc., Beijing (CN)

(72) Inventors: Baicen Hou, Beijing (CN); Mingyong Tang, Beijing (CN); Chengping Hua, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 171 days.

(21) Appl. No.: 14/533,106

(22) Filed: Nov. 5, 2014

(65) Prior Publication Data

US 2015/0235534 A1 Aug. 20, 2015

Related U.S. Application Data

(63) Continuation of application No. PCT/CN2014/082914, filed on Jul. 24, 2014.

(30) Foreign Application Priority Data

Feb. 19, 2014 (CN) ..... 2014 1 0056912

(51) Int. Cl.
*G08B 13/12* (2006.01)
*G08B 25/00* (2006.01)
*G08B 21/02* (2006.01)

(52) U.S. Cl.
CPC ..... *G08B 25/008* (2013.01); *G08B 21/0297* (2013.01)

(58) Field of Classification Search
None
See application file for complete search history.

(56) References Cited

U.S. PATENT DOCUMENTS

2012/0182146 A1* 7/2012 Berglund ..... G08B 13/1445 340/568.2
2014/0292526 A1* 10/2014 Hansson ..... G08B 15/004 340/687

FOREIGN PATENT DOCUMENTS

CN 1652559 A 8/2005
CN 101567923 A 10/2009
(Continued)

OTHER PUBLICATIONS

"European Search Report for 14194305.1-1803".
"International Search Report for PCT/CN2014/082914".

*Primary Examiner* — Brian Zimmerman
*Assistant Examiner* — Thomas McCormack
(74) *Attorney, Agent, or Firm* — Jun He Law Offices P.C.; James J. Zhu

(57) ABSTRACT

The present disclosure relates to a method for protecting a terminal device and the terminal device thereof. The method includes: obtaining status information of a terminal device plugged with an earphone; determining whether the status information meets a preset condition; and activating an alarm mode of the terminal device when the status information meets the preset condition. According to the present disclosure, given that activating the alarm mode of the terminal device is based on the status information of the terminal device, the alarm mode of the terminal device can be activated based on environment information of the terminal device without a user manually activating the alarm mode of the terminal device, therefore user experience is improved. Moreover, the security of the terminal device is further improved by avoiding an incident of the user forgetting to start the alarm mode, thus further protecting the terminal device.

18 Claims, 8 Drawing Sheets

(56) References Cited

FOREIGN PATENT DOCUMENTS

| | | | |
|---|---|---|---|
| CN | 101783845 | A | 7/2010 |
| CN | 102013145 | A | 4/2011 |
| CN | 102915607 | A | 2/2013 |
| CN | 103024164 | A | 4/2013 |
| CN | 103051787 | A | 4/2013 |
| CN | 103220637 | A | 7/2013 |
| CN | 103327175 | A | 9/2013 |
| CN | 103365554 | A | 10/2013 |
| CN | 103841264 | A | 6/2014 |
| JP | 2009053855 | A | 3/2009 |
| KR | 1020120033571 | A | 4/2012 |
| KR | 101209558 | B1 | 12/2012 |
| KR | 200469009 | Y1 | 9/2013 |
| KR | 1020130126261 | A | 11/2013 |
| KR | 20140008734 | A | 1/2014 |
| RU | 22060840 | C2 | 9/2005 |
| RU | 66093 | U1 | 8/2007 |
| RU | 67306 | U1 | 10/2007 |

* cited by examiner

METHOD FOR PROTECTING TERMINAL DEVICES AND THE TERMINAL DEVICE THEREOF

CROSS REFERENCE TO RELATED APPLICATIONS

This application is a Continuation of International Application No. PCT/CN2014/082914, filed on Jul. 24, 2014, which is based upon and claims priority to Chinese Patent Application No. 201410056912.0, filed on Feb. 19, 2014, the entire contents of which are incorporated herein by reference.

TECHNICAL FIELD

The present disclosure relates to a field of terminal technology, and more particular, to a method for protecting terminal devices and the terminal device thereof.

BACKGROUND

With the continuous development of terminal technology, terminal devices have become more functional and provided users with better experiences, so people are increasingly using the terminal devices in various occasions. For example, people use the terminal devices to surf the Internet, watch videos, listen to music and the like while riding public transportations, and use the terminal devices to listen to music, record running information (running route, run duration) or the like while exercising or running.

As people increasingly use the terminal devices in various occasions, in particular to use the terminal devices in public places, the terminal devices become a target of larceny and robbery. For example, when a user listens to music with earphone plugged into the terminal device, the terminal device is generally placed in a pocket or a carry-on bag, which offers criminals an opportunity to take out the terminal device, unplug the earphone quickly and run away. Therefore, a method for protecting the terminal devices is required.

SUMMARY

Accordingly, the present disclosure provides a method for protecting a terminal device and the terminal device thereof.

According to a first aspect of the present disclosure, a method for protecting a terminal device is provided. The method includes: obtaining status information of the terminal device plugged with an earphone; determining whether the status information meets a preset condition; and activating an alarm mode of the terminal device when the status information meets the preset condition.

According to a second aspect of the present disclosure, a terminal device is provided. The terminal device includes: a processor; and a memory for storing instructions executable by the processor, wherein the processor is configured to: obtain status information of the terminal device plugged with an earphone; determine whether the status information meets a preset condition; and activate an alarm mode of the terminal device when the status information meets the preset condition.

According to a third aspect of the present disclosure, a non-transitory readable storage medium is provided. The non-transitory readable storage medium includes instructions executable by one or more processors in a terminal device and for causing the one or more processors to obtain status information of the terminal device plugged with an earphone; determine whether the status information meets a preset condition; and activate an alarm mode of the terminal device when the status information meets the preset condition.

The solutions provided by the embodiments of the present disclosure may have the following advantages.

According to the present disclosure, given that activating the alarm mode of the terminal device is based on the status information of the terminal device, the alarm mode of the terminal device can be activated based on environment information of the terminal device without a user manually activating the alarm mode of the terminal device, therefore user experience is improved. Moreover, the security of the terminal device is further improved by avoiding an incident of the user forgetting to start the alarm mode, thus further protecting the terminal device.

It is to be understood that both the foregoing general description and the following detailed description are exemplary and explanatory only and are not restrictive of the invention, as claimed.

DETAILED DESCRIPTION

Herein, exemplary embodiments will be described in detail, examples of which are shown in figures.

To make the objectives, solutions and advantages of the present disclosure more apparent, reference will now be made in detail to the exemplary embodiments, examples of which are illustrated in the accompanying drawings. The following exemplary embodiments and description thereof intend to illustrate, rather than to limit, the discourse. Unless stated clearly otherwise, same numerals in different figures indicate same or similar elements when the description refers to figures. Implementation manners described in the following exemplary embodiments do not cover all implementation manners being consisted with the present disclosure. On the country, they are only examples of method and device consisted with some aspects of the present disclosure described in claims.

Figure 1:
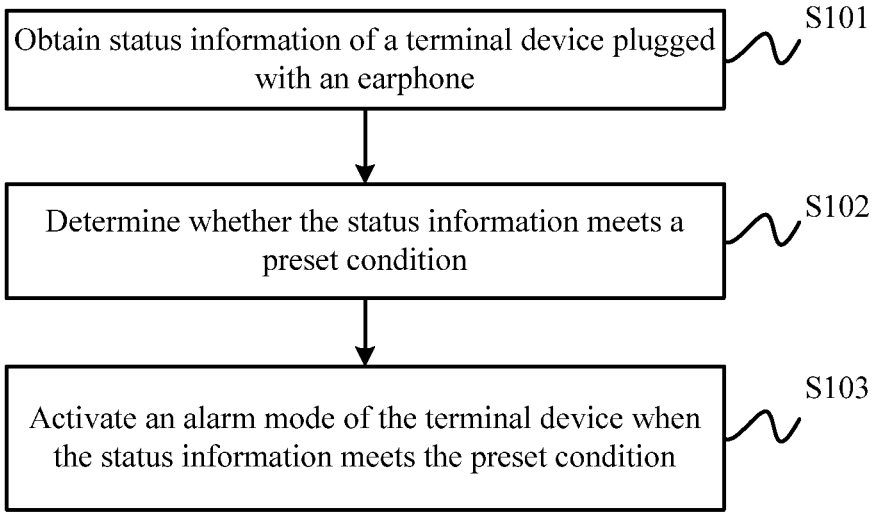
FIG. 1 is a flowchart showing a method for protecting a terminal device according to an exemplary embodiment.

FIG. 1 is a flowchart showing a method for protecting a terminal device according to an exemplary embodiment. As shown in FIG. 1, the method for protecting a terminal device is implemented by the terminal device and includes the following steps.

In step 101, status information of the terminal device plugged with an earphone is obtained.

The status information includes, but is not limited to, one or more of the following information: environment information of the terminal device, motion information of the terminal device, information of a program running in the terminal device, information on whether the terminal device is in a screen-off state, and information on whether an image captured by a front camera of the terminal device includes a face.

For example, the environment information of the terminal device includes: GPS information of the terminal device and information of a Wi-Fi network accessed by the terminal device. The information of a Wi-Fi network accessed by the terminal device is used to identify the Wi-Fi network and may include name or Short for Service Set Identifier (SSID) of a Wi-Fi network accessed by the terminal device.

For example, the motion information of the terminal device includes, but is not limited to, one or more of the following information: a vibration frequency of the terminal device, a displacement of the terminal device, a speed of the terminal device and an acceleration of the terminal device.

In step 102, it is determined whether the status information meets a preset condition.

In step 103, an alarm mode of the terminal device is activated when the status information meets the preset condition.

The alarm mode of the terminal device means that the terminal device performs alarm operation to warn the user when the earphone plugged into terminal device is unplugged. The alarm operation includes, but is not limited to, one or more of the following manners: an audible alarm, a vibration alarm, a flashing alarm, and a lock screen operation. If the terminal device enters into the lock screen operation, it is required to be unlocked by using a password.

According to the present disclosure, given that activating the alarm mode of the terminal device is based on the status information of the terminal device, the alarm mode of the terminal device can be activated based on environment information of the terminal device without a user manually activating the alarm mode of the terminal device, therefore user experience is improved. Moreover, the security of the terminal device is further improved by avoiding an incident of the user forgetting to start the alarm mode, thus further protecting the terminal device.

Figure 2:
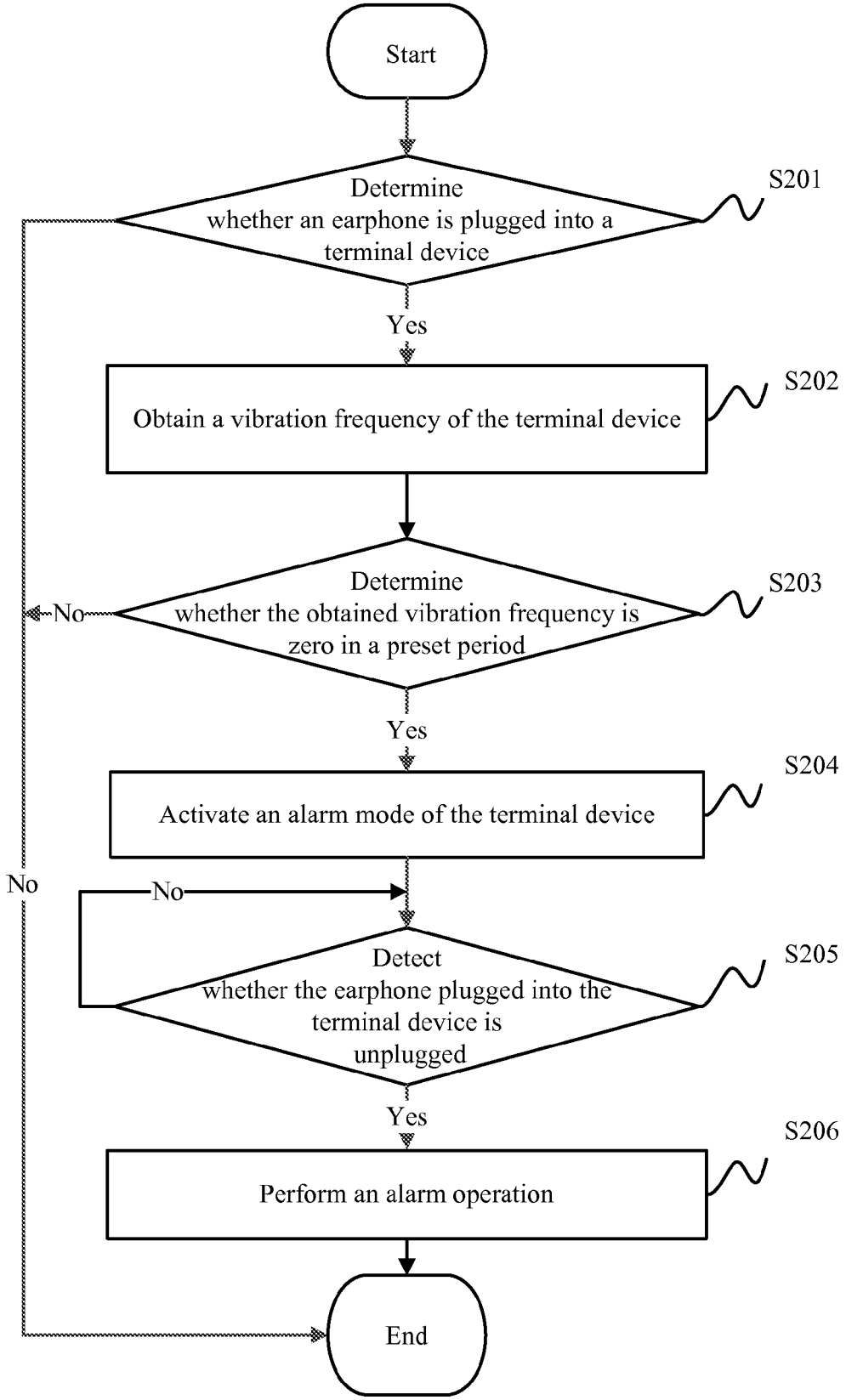
FIG. 2 is a flowchart showing a method for protecting a terminal device according to an exemplary embodiment.

FIG. 2 is a flowchart showing a method for protecting a terminal device according to another exemplary embodiment. As shown in FIG. 2, the method for protecting a terminal device is implemented by a terminal device. In this embodiment, a preset condition for activating an alarm mode of the terminal device is that a vibration frequency of the terminal device is not zero in a preset period. The method includes the following steps.

In step 201, it is determined whether an earphone is plugged into the terminal device; if yes, the process proceeds to step 202; and if no, the process ends.

In step 202, the vibration frequency of the terminal device is obtained.

The vibration frequency is one of the motion information. Motion information may be obtained through sensors provided in the terminal device, such as a vibration sensor and an acceleration sensor. Additionally, the motion information may be obtained through GPS technology. For example, a return value of GPS is changed due to a person's movement; therefore, it is possible to determine whether the terminal device is in a state in which its location is always changed by detecting a change of GPS' value. When the user uses the terminal device is in a walking or running state, the terminal device carried by the user can generate a corresponding acceleration, a vibration frequency or a displacement. Therefore, it can be determined whether the user (and the terminal device) is in a motion state by using the motion information of the terminal device.

In step 203, it is determined whether the obtained vibration frequency is zero in the preset period; if yes, the process proceeds to step S204; and if no, the process ends.

When the vibration frequency of the motion information is not zero, it is determined that the terminal device is in the motion state.

In step 204, the alarm mode of the terminal device is activated.

In step 205, it is detected whether the earphone plugged into the terminal device is unplugged; if yes, the process proceeds to step 206; and if no, step 205 is performed repeatedly.

A process of unplugging the earphone from a smart phone may cause small current variations. A state of plugging/unplugging and an action process of plugging/unplugging may be determined through detecting the variations of current.

In step 206, the alarm operation is performed.

The alarm operation includes, but is not limited to, one or more of the following manners: an audible alarm, a vibration alarm, a flashing alarm, and a lock screen operation. For example, the alarm operation includes the audible alarm with loudest sound in a system, the flashing alarm with strongest light of LED, the vibration alarm with highest vibration frequency and the lock screen operation in which the screen displays an interface for inputting a password to require a user to input a preset figure or number to unlock the screen. The phone cannot perform any instruction before the screen is unlocked; if the input password is wrong, the terminal device keeps the lock-screen state until the right password is input. If the right password is input, the alarm is deactivated, the sound stops, the flash light of the LED is turned off, the vibration is stopped and the phone is switched to a normal state.

In the embodiment, once it is detected that the terminal device is in the motion state, the alarm mode of the terminal device is activated, thereby providing protection for a terminal device in the motion state such as a walking state and a running state.

Figure 3:
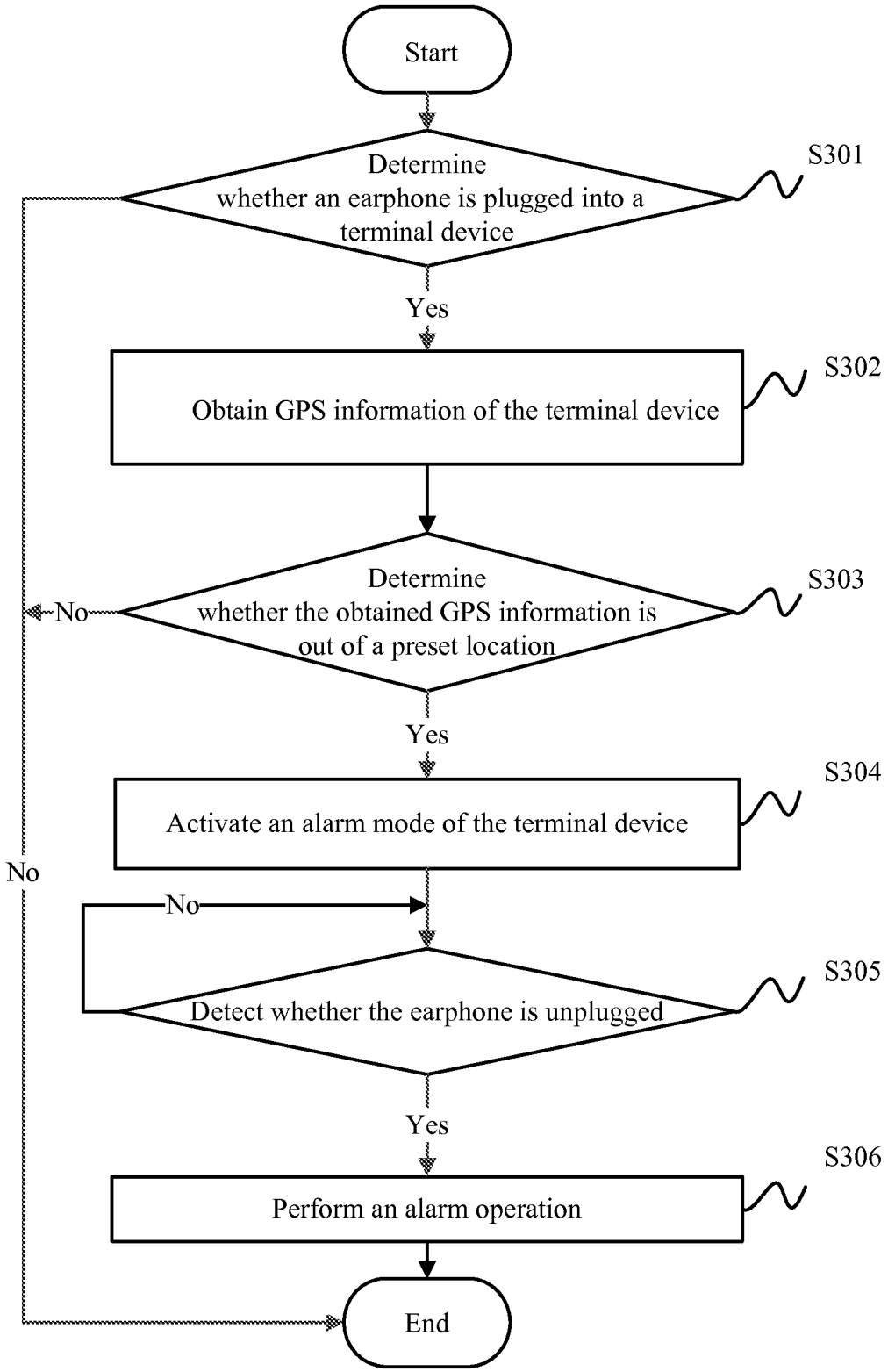
FIG. 3 is a flowchart showing a method for protecting a terminal device according to an exemplary embodiment.

FIG. 3 is a flowchart showing a method for protecting a terminal device according to another exemplary embodiment. As shown in FIG. 3, the method for protecting a terminal device is implemented by the terminal device. In this embodiment, a preset condition for activating an alarm mode of the terminal device is that the GPS information of the terminal device indicates the terminal device is out of a preset location. The method includes the following steps.

In step 301, it is determined whether an earphone is plugged into the terminal device; if yes, the process proceeds to step 302; and if no, the process ends.

In step 302, the GPS information of the terminal device is obtained.

In step 303, it is determined whether the obtained GPS information indicates the terminal device is out of the preset location; if yes, the process proceeds to step S304; if no, the process ends.

For example, the preset location includes a location of home, a location of company, so that it can be determined whether the terminal device is in home or company according to the obtained GPS information.

In step 304, the alarm mode of the terminal device is activated.

In step 305, it is detected whether the earphone plugged into the terminal device is unplugged; if yes, the process proceeds to step 306; if no, step 305 is performed repeatedly.

In step 306, the alarm operation is performed.

In the embodiment, once it is detected that the terminal device indicates the terminal device is out of a preset location, the alarm mode of the terminal device is activated, which can provide protection for terminal device in service environment other than home and company.

Figure 4:
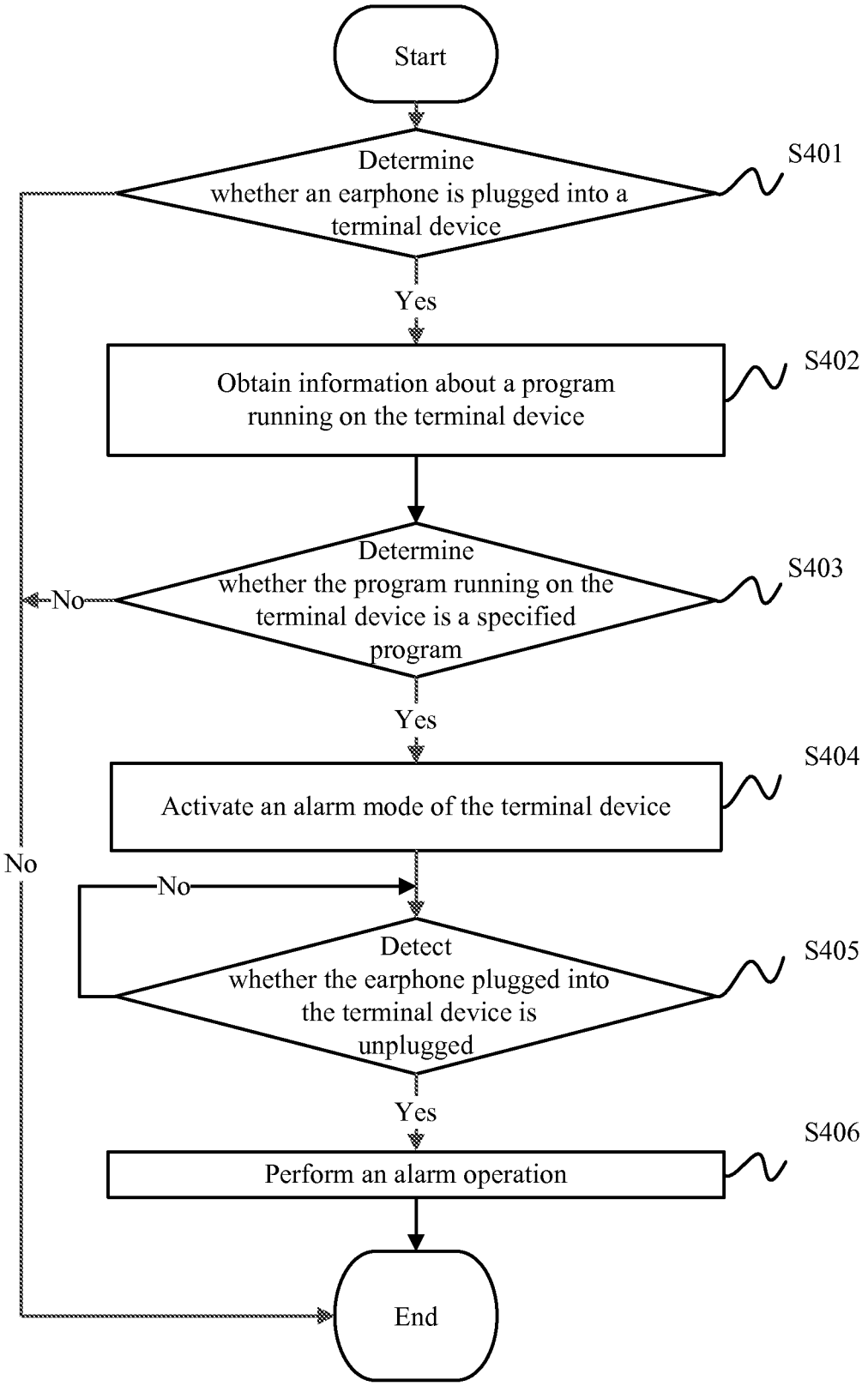
FIG. 4 is a flowchart showing a method for protecting a terminal device according to an exemplary embodiment.

FIG. 4 is a flowchart showing a method for protecting a terminal device according to another exemplary embodiment. As shown in FIG. 4, the method for protecting a terminal device is implemented by the terminal device. In this embodiment, a preset condition for activating an alarm mode of the terminal device is that the program running on the terminal device is a specified program. The method includes the following steps.

In step 401, it is determined whether an earphone is plugged into the terminal device; if yes, the process proceeds to step 402; and if no, the process ends.

In step 402, the information of a program running on the terminal device is obtained.

In step 403, it is determined whether the program running on the terminal device is a specified program; if yes, the process proceeds to step S404; if no, the process ends.

For example, the specified program may be one of an application program for playing music, an application program for receiving radio broadcast, and an application program for receiving a call. The phone may be put in a pocket when the user uses these application programs.

In step 404, the alarm mode of the terminal device is activated.

In step 405, it is detected whether the earphone plugged into the terminal device is unplugged; if yes, the process proceeds to step 406; and if no, step 405 is performed repeatedly.

In step 406, the alarm operation is performed.

In the embodiment, once it is detected that the program running on the terminal device is the specified program (a user generally wears the earphone and then puts the terminal device in a pocket when using these application programs), the alarm mode of the terminal device is activated, thereby providing a protection for the terminal device with the earphone.

Figure 5:
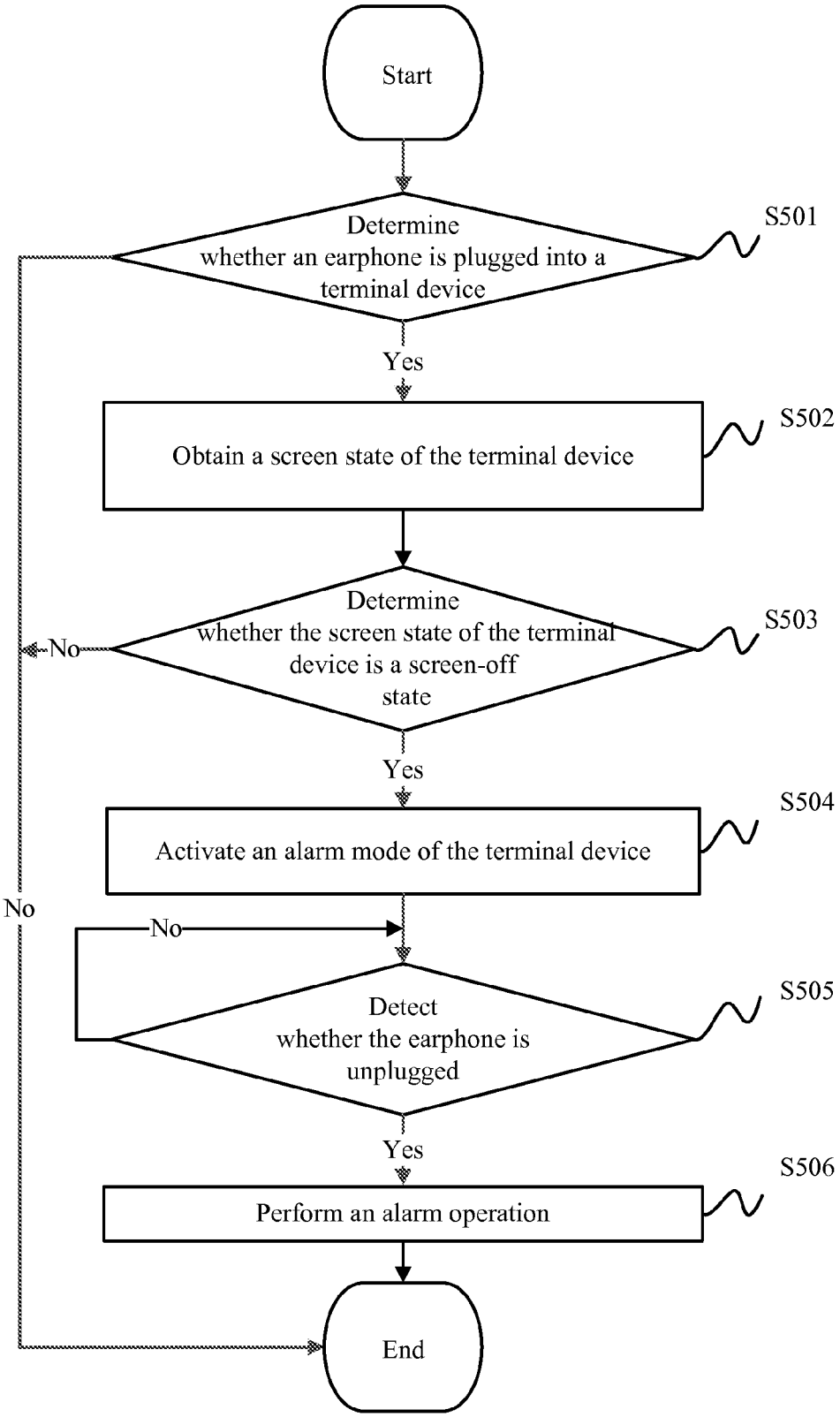
FIG. 5 is a flowchart showing a method for protecting a terminal device according to an exemplary embodiment.

FIG. 5 is a flowchart showing a method for protecting a terminal device according to another exemplary embodiment. As shown in FIG. 5, the method for protecting a terminal device is implemented by the terminal device. In this embodiment, a preset condition for activating an alarm mode of the terminal device is that a screen state of the terminal device is a screen-off state. The method includes the following steps.

In step 501, it is determined whether an earphone is plugged into the terminal device; if yes, the process proceeds to step 502; if no, the process ends.

In step 502, the screen state of the terminal device is obtained.

In step 503, it is determined whether the screen state of the terminal device is the screen-off state; if yes, the process proceeds to step S504; if no, the process ends.

In step 504, the alarm mode of the terminal device is activated.

In step 505, it is detected whether the earphone plugged into the terminal device is unplugged; if yes, the process proceeds to step 506; if no, step 505 is performed repeatedly.

In step 506, the alarm operation is performed.

In the embodiment, the alarm mode of the terminal device is activated only when it is detected that the screen of the terminal device is in the screen-off state, so as to avoid waste of resources due to activating the alarm mode when the user watches video or plays game using the earphone, since the terminal device is not easily stolen when the user watches video or plays game.

Figure 6:
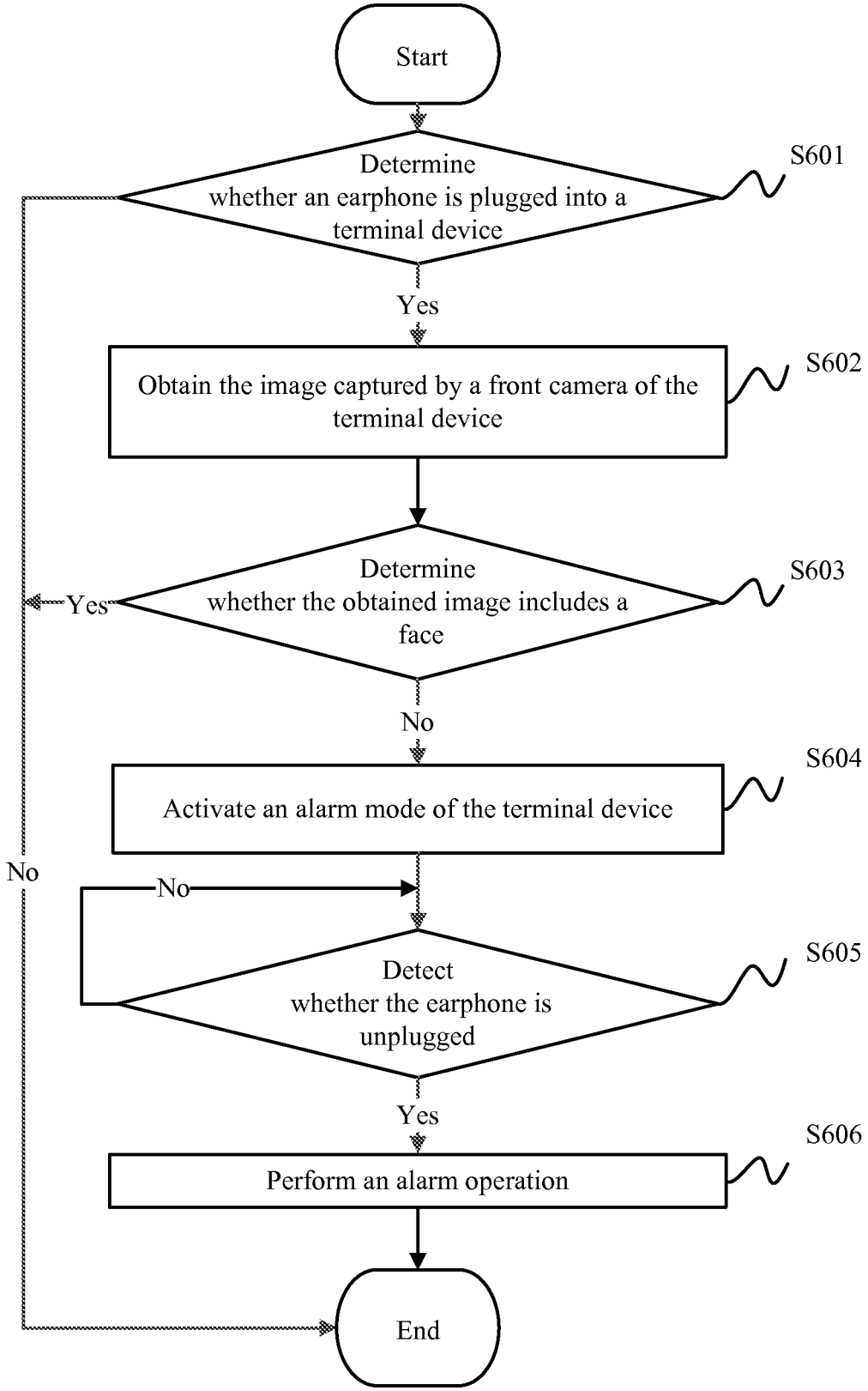
FIG. 6 is a flowchart showing a method for protecting a terminal device according to an exemplary embodiment.

FIG. 6 is a flowchart showing a method for protecting a terminal device according to another exemplary embodiment. As shown in FIG. 6, the method for protecting a terminal device is implemented by the terminal device. In this embodiment, an image captured by a front camera of the terminal device is obtained, and an alarm mode of the terminal device is not activated when the image includes a face. The method includes the following steps.

In step 601, it is determined whether an earphone is plugged into the terminal device; if yes, the process proceeds to step 602; if no, the process ends.

In step 602, the image captured by a front camera of the terminal device is obtained.

In step 603, it is determined whether the obtained image includes a face; if yes, the process proceeds to step S604; if no, the process ends.

Alternatively, in step 603, it is determined whether the obtained image includes a specified face, such as a face of the owner of the terminal device.

In step 604, the alarm mode of the terminal device is activated.

In step 605, it is detected whether the earphone plugged into the terminal device is unplugged; if yes, the process proceeds to step 606; if no, step 605 is performed repeatedly.

In the embodiment, when it is detected that the image captured by a front camera includes the specific face, the alarm mode of the terminal device is not activated. That is because the case in which the image captured by a front camera includes the face means that the user faces to the terminal device, and in this case the terminal device is not easily stolen. Therefore, it can avoid the waste of resources due to activating the alarm mode.

In another embodiment of the present disclosure, even if it is detected that the earphone is plugged into the terminal device again during alarm operation, the alarm operation may be continued. Therefore, in the case that the terminal device starts the alarm operation, and the alarm operation will not stop even if the earphone is plugged into the terminal device again.

In other embodiments of the present disclosure, two or more items of implementations of the above embodiments may be combined. For example, an implementation of determining whether the program running on the terminal device is the specified program, and another implementation of determining whether the screen state of the terminal device is the screen-off state, may be combined, so that the alarm operation is performed when the application program running on the terminal device is a music player and the screen of the terminal device is in the screen-off state. That is because the screen-on state generally means that the user is using the terminal device in a visible range, so it is unnecessary to perform the alarm operation. For example, an implementation of determining whether the obtained GPS information indicates the terminal device is out of the preset location, and another implementation of determining whether the image obtained by the front camera includes a face, may be combined, so that the alarm operation is performed when the GPS information obtained by the terminal device indicates the terminal device is out of the preset location and the image obtained by the front camera does not include a face. That is because there may be a case that the GPS information of the terminal device indicates the terminal device is out of the preset location but the user is using the terminal device face to face, thus it is unnecessary to perform the alarm operation so as to save resource.

Accordingly, the person skilled in the art should appreciate that the method for protecting a terminal device according to the present disclosure intends to automatically activate the alarm operation of the terminal device when the preset condition is met, so that interference to the user's normal operation may be reduced as much as possible. Moreover, time cost for the user to form an operation habit to manually activate the alarm mode in an occasion in which the terminal device is possibly lost may be reduced. Meanwhile, given that the alarm mode may be activated automatically, the incidents where the user forgets to start the alarm mode or before the user starts the alarm mode may be avoided to some extent, so that the function of "activating alarm upon unplugging the earphone" can provide better experience and have better operation effect. The preset condition may be set as required and is not limited to the embodiments of the present disclosure.

Figure 7:
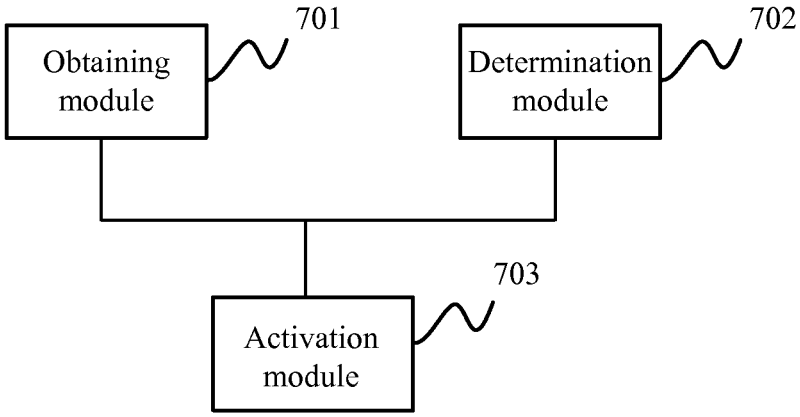
FIG. 7 is a block diagram showing an apparatus for protecting a terminal device according to an exemplary embodiment.

FIG. 7 is a block diagram showing an apparatus for protecting a terminal device according to an exemplary embodiment. As shown in FIG. 7, the apparatus includes an obtaining module 701, a determining module 702 and an activation module 703.

The obtaining module 701 is configured to obtain status information of a terminal device plugged with an earphone.

The determining module 702 is configured to determine whether the status information meets a preset condition.

The activation module 703 is configured to activate an alarm mode of the terminal device when the status information meets the preset condition.

The status information includes, but is not limited to, one or more of the following information: environment information of the terminal device, motion information of the terminal device, information of a program running on the terminal device, information on whether the terminal device is in a screen-off state, and information on whether an image captured by a front camera of the terminal device includes a face.

The environment information of the terminal device includes one or more of the following information: GPS information of the terminal device and information of a Wi-Fi network accessed by the terminal device.

Figure 8:
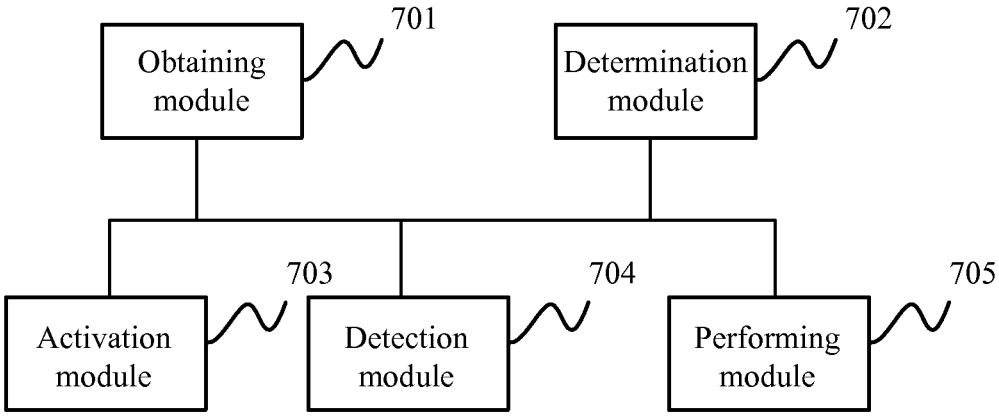
FIG. 8 is a block diagram showing an apparatus for protecting a terminal device according to an exemplary embodiment.

As shown in FIG. 8, the device also includes a detection module 704 and a performing module 705.

The detection module 704 is configured to detect whether the earphone is unplugged after the alarm mode of the terminal device is activated.

The performing module 705 is configured to perform the alarm operation when it is detected that the earphone is unplugged.

The alarm operation includes one or more of the following manners: an audible alarm, a vibration alarm, a flashing alarm, and a lock screen operation.

The performing module 705 is also configured to continue to perform the alarm operation even if it is detected that the earphone is plugged into the terminal device during the alarm operation.

As for the apparatus according to the above embodiments, the implementation that respective modules of the apparatus perform operations has been described in detail in the corresponding embodiments of the method, and thus will not be repeated.

Figure 9:
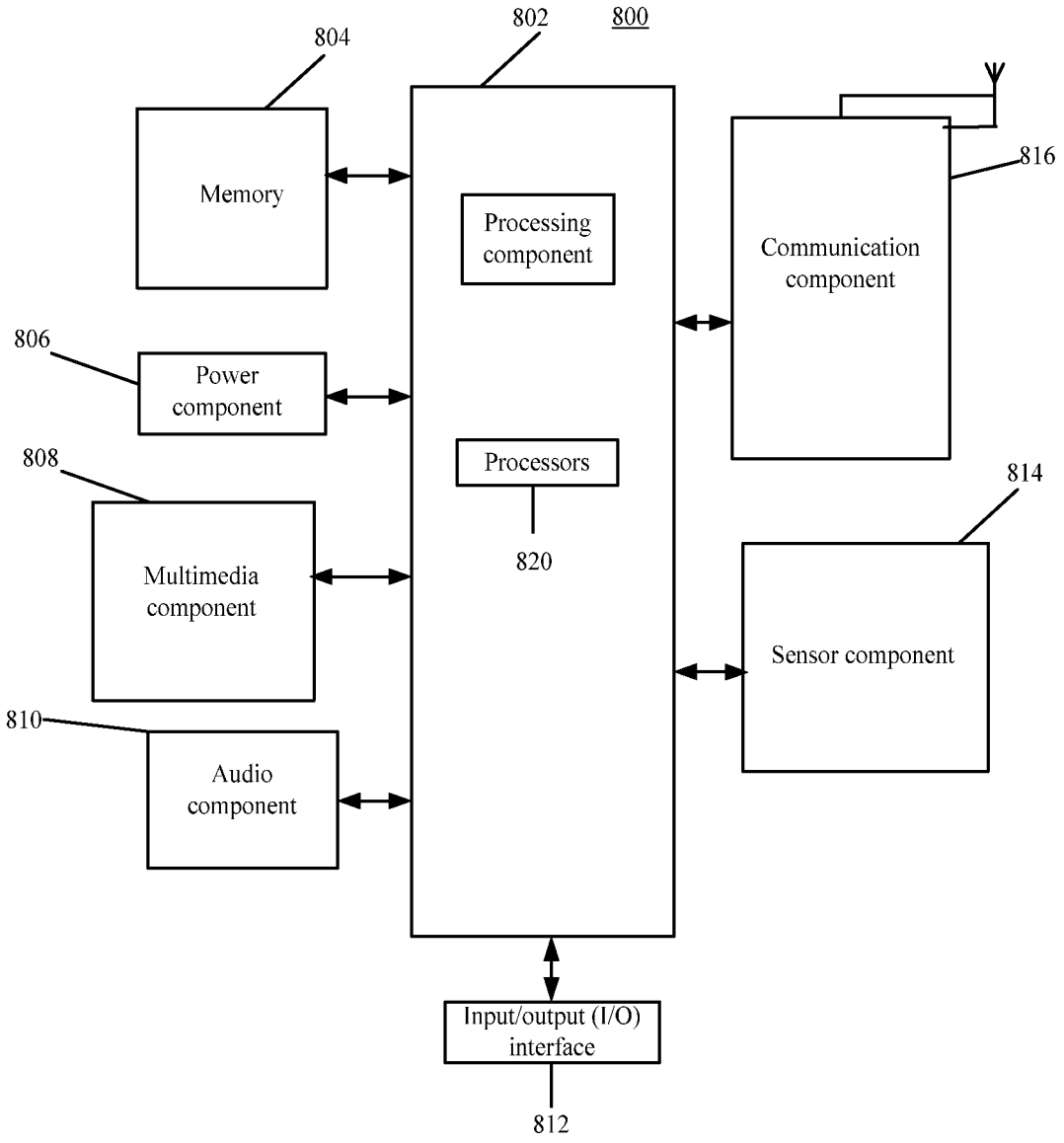
FIG. 9 is a block diagram showing a terminal device according to an exemplary embodiment.

FIG. 9 is a block diagram of a terminal device 800 according to an exemplary embodiment. For example, the terminal device 800 may be a mobile phone, a computer, a digital broadcast terminal, a messaging device, a gaming console, a tablet, a medical device, an exercise device, a personal digital assistant, or the like.

Referring to FIG. 9, the terminal device 800 may include one or more of the following components: a processing component 802, a memory 804, a power component 806, a multimedia component 808, an audio component 810, an input/output (I/O) interface 812, a sensor component 814, and a communication component 816.

The processing component 802 typically controls overall operations of the terminal device 800, such as the operations associated with display, telephone calls, data communications, camera operations, and recording operations. The processing component 802 may include one or more processors 820 to execute instructions to perform all or part of the steps in the above described methods. Moreover, the processing component 802 may include one or more modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the terminal device 800. Examples of such data include instructions for any applications or methods operated on the terminal device 800, contact data, phonebook data, messages, pictures, video, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the terminal device 800. The power component 806 may include a power management system, one or more power sources, and any other components associated with the generation, management, and distribution of power in the terminal device 800.

The multimedia component 808 includes a screen providing an output interface between the terminal device 800 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 808 includes a front camera and/or a rear camera. The front camera and the rear camera may receive an external multimedia datum while the terminal device 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone ("MIC") configured to receive an external audio signal when the terminal device 800 is in an operation mode, such as a call mode, a recording mode, and a voice recognition mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, buttons, and the like. The buttons may include, but are not limited to, a home button, a volume button, a starting button, and a locking button.

The sensor component 814 includes one or more sensors to provide status assessments of various aspects of the terminal device 800. For instance, the sensor component 814 may detect an open/closed status of the terminal device 800, relative positioning of components, e.g., the display and the keypad, of the terminal device 800, a change in position of the terminal device 800 or a component of the terminal device 800, a presence or absence of user contact with the terminal device 800, an orientation or an acceleration/deceleration of the terminal device 800, and a change in temperature of the terminal device 800. The sensor component 814 may include a proximity sensor configured to detect the presence of nearby objects without any physical contact. The sensor component 814 may also include a light sensor, such as a CMOS or CCD image sensor, for use in imaging applications. In some embodiments, the sensor component 814 may also include an accelerometer sensor, a gyroscope sensor, a magnetic sensor, a pressure sensor, or a temperature sensor.

The communication component 816 is configured to facilitate communication, wired or wirelessly, between the terminal device 800 and other devices. The terminal device 800 can access a wireless network based on a communication standard, such as WiFi, 2G, or 3G, or a combination thereof. In one exemplary embodiment, the communication component 816 receives a broadcast signal or broadcast associated information from an external broadcast management system via a broadcast channel. In one exemplary embodiment, the communication component 816 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the terminal device 800 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as included in the memory 804, executable by the processor 820 in the terminal device 800, for performing the above-described methods. For example, the non-transitory computer-readable storage medium may be a ROM, a RAM, a CD-ROM, a magnetic tape, a floppy disc, an optical data storage device, and the like.

A non-transitory computer-readable storage medium has stored therein instructions that, when executed by a processor of a terminal device, cause the terminal device to perform a method for protecting a terminal device, and the method comprises the following steps of obtaining status information of a terminal device plugged with an earphone, determining whether the status information meets a preset condition, and activating an alarm mode of the terminal device when the status information meets the preset condition.

The person skilled in the art easily anticipates other solutions after consideration of the above description and implementation of the present disclosure. The present disclosure intends to cover any variation, usage or modification which follow a general principle of the present disclosure, and include common knowledge or usual technical means in the art. The description and embodiments are exemplary and the scope and principle of the present disclosure are limited by the appending claims.

It will be appreciated that the above embodiments are exemplary and the present disclosure is not limited thereto, and that various modifications and changes can be made without departing from the scope thereof. It is intended that the scope of the invention only be limited by the appended claims.

What is claimed is:

1. A method for protecting a terminal device, comprising:

obtaining status information of the terminal device plugged with only an earphone, wherein the status information comprises information on whether a program running in the terminal device is a specified program and information on whether the terminal device is in a screen-off state;

determining whether the status information meets a preset condition; and activating an alarm mode of the terminal device when the status information meets the preset condition.

2. The method according to claim 1, wherein the status information comprises one or more of environment information of the terminal device, motion information of the terminal device, information of a program running in the terminal device, information on whether the terminal device is in a screen-off state, and information on whether an image captured by a front camera of the terminal device includes a face.

3. The method according to claim 1, wherein the environment information of the terminal device comprises one or more of GPS information of the terminal device and information of a Wi-Fi network accessed by the terminal device.

4. The method according to claim 1, wherein after the alarm mode of the terminal device is activated, the method further comprises:

detecting whether the earphone is unplugged; and performing an alarm operation when it is detected that the earphone is unplugged.

5. The method according to claim 4, wherein the alarm operation comprises one or more of an audible alarm, a vibration alarm, a flashing alarm, and a lock screen operation.

6. The method according to claim 4, wherein the alarm operation is continued even if it is detected that the earphone is plugged into the terminal device during the alarm operation.

7. A terminal device, comprising:

a processor; and a memory for storing instructions executable by the processor, wherein the processor is configured to:

obtain status information of the terminal device plugged with only an earphone, wherein the status information comprises information on whether a program running in the terminal device is a specified program and information on whether the terminal device is in a screen-off state;

determine whether the status information meets a preset condition; and activate an alarm mode of the terminal device when the status information meets the preset condition.

8. The terminal device according to claim 7, wherein the status information comprises one or more of environment information of the terminal device, motion information of the terminal device, information of a program running in the terminal device, information on whether the terminal device is in a screen-off state, and information on whether an image captured by a front camera of the terminal device includes a face.

9. The terminal device according to claim 7, wherein the environment information of the terminal device comprises one or more of GPS information of the terminal device and information of a Wi-Fi network accessed by the terminal device.

10. The terminal device according to claim 7, wherein after the alarm mode of the terminal device is activated, the processor is further configured to:

detect whether the earphone is unplugged; and perform an alarm operation when it is detected that the earphone is unplugged.

11. The terminal device according to claim 10, wherein the alarm operation comprises one or more of an audible alarm, a vibration alarm, a flashing alarm, and a lock screen operation.

12. The terminal device according to claim 10, wherein the alarm operation is continued even if it is detected that the earphone is plugged into the terminal device during the alarm operation.

13. A non-transitory readable storage medium comprising instructions, executable by one or more processors in a terminal device and for causing the one or more processors to:

obtain status information of the terminal device plugged with only an earphone, wherein the status information comprises information on whether a program running in the terminal device is a specified program and information on whether the terminal device is in a screen-off state;

determine whether the status information meets a preset condition; and activate an alarm mode of the terminal device when the status information meets the preset condition.

14. The storage medium according to claim 13, wherein the status information comprises one or more of environment information of the terminal device, motion information of the terminal device, information of a program running in the terminal device, information on whether the terminal device is in a screen-off state, and information on whether an image captured by a front camera of the terminal device includes a face.

15. The storage medium according to claim 13, wherein the environment information of the terminal device comprises one or more of GPS information of the terminal device and information of a Wi-Fi network accessed by the terminal device.

16. The storage medium according to claim 13, wherein after the alarm mode of the terminal device is activated, the processor is further configured to:

detect whether the earphone is unplugged; and perform an alarm operation when it is detected that the earphone is unplugged.

17. The storage medium according to claim 16, wherein the alarm operation comprises one or more of an audible alarm, a vibration alarm, a flashing alarm, and a lock screen operation.

18. The storage medium according to claim 16, wherein the alarm operation is continued even if it is detected that the earphone is plugged into the terminal device during the alarm operation.

* * * * *